US006675788B2

(12) United States Patent
Inoue et al.

(10) Patent No.: US 6,675,788 B2
(45) Date of Patent: Jan. 13, 2004

(54) AIR-FUEL RATIO CONTROL APPARATUS FOR AN INTERNAL COMBUSTION ENGINE AND CONTROLLING METHOD

(75) Inventors: Hitoshi Inoue, Tokyo (JP); Koji Nishimoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 135 days.

(21) Appl. No.: 10/017,395

(22) Filed: Dec. 18, 2001

(65) Prior Publication Data

US 2003/0000510 A1 Jan. 2, 2003

(30) Foreign Application Priority Data

Jun. 29, 2001 (JP) ..... 2001-198231

(51) Int. Cl.[7] ..... F02D 41/00
(52) U.S. Cl. ..... 123/698; 123/672; 123/520
(58) Field of Search ..... 123/698, 672, 123/434, 520

(56) References Cited

U.S. PATENT DOCUMENTS 5,150,686 A * 9/1992 Okawa et al. ..... 123/698
5,216,997 A 6/1993 Osanai et al.
5,626,122 A 5/1997 Azuma
5,676,118 A * 10/1997 Saito ..... 123/679
5,699,778 A * 12/1997 Muraguchi et al. ..... 123/698
5,727,537 A 3/1998 Nakagawa et al.

* cited by examiner

*Primary Examiner*—Bibhu Mohanty
(74) *Attorney, Agent, or Firm*—Sughrue Mion, PLLC

(57) ABSTRACT

An air-fuel ratio control apparatus for an internal combustion engine in which an air-fuel ratio is always controlled to be a target value with accuracy when purge air is introduced is obtained.

The air-fuel ratio control apparatus for an internal combustion engine is provided with purge control quantity setting means 31 that introduces fuel vapor as purge air into an intake system on the basis of a value detected by an operating condition detecting means 30 detecting an operating conditions of an internal combustion engine 6 and controls a quantity of the introduced purge air, a fuel injection quantity calculating means 41 controlling an air-fuel ratio to be a target value on the basis of a value detected by an air-fuel ratio sensor 16 detecting an air-fuel ratio of air-fuel mixture fed into the internal combustion engine 6, a purging state detecting means 39 detecting a state of introduction of the purge air, and a purge air introduction correcting means 40 calculating a correction coefficient for correcting the air-fuel ratio which is changed by starting the introduction of the purge air on the basis of signals of the operating condition detecting means 30 and the purging state detecting means 39, and when the purge air introduction correcting means 40 detects the start of the introduction of the purge air, the correction coefficient is calculated and the fuel injection quantity is corrected.

8 Claims, 5 Drawing Sheets

6: INTERNAL COMBUSTION ENGINE
7: INJECTOR
9: CANISTER
10: PURGE CONTROL VALVE
16: AIR-FUEL RATIO SENSOR
20: CONTROL APPARATUS

AIR-FUEL RATIO CONTROL APPARATUS FOR AN INTERNAL COMBUSTION ENGINE AND CONTROLLING METHOD

BACKGROUND OF THE INVENTION

1. Technical Field

The present invention relates to an air-fuel ratio control apparatus for an internal combustion engine provided with a function of controlling feedback of an air-fuel ratio and a function of controlling purge.

2. Background Art

In internal combustion engine for vehicle, a fuel vapor generated from a fuel tank or the like is adsorbed by an activated charcoal of a canister and introduced into an intake system. This process is what is called a purging operation. An exhaust passage is provided with an air-fuel ratio sensor, and feedback of a fuel injection quantity is controlled so that the air-fuel ratio of air-fuel mixture fed to the internal combustion engine may be a theoretical air-fuel ratio. In such an internal combustion engine, an air-fuel ratio feedback correction coefficient varies with 1.0 as a reference value, when no purging operation of the fuel vapor is carried out. However, when starting the purging operation, it becomes necessary to reduce the fuel injection quantity according to the purged quantity of the vapor fuel. Therefore it is essential to establish the air-fuel ratio feedback correction coefficient to be a value smaller than the reference value of 1.0.

In this manner, the air-fuel ratio feedback correction coefficient in the purging operation is controlled to be various values with respect to the reference value depending upon operating conditions of the internal combustion engine, i.e., depending upon ratio of intake air quantity to a purge quantity (hereinafter referred to as a purge rate). For example, if a purge control valve disposed in an introduction passage for the fuel vapor is constantly opened with a fixed degree, the air-fuel ratio feedback correction coefficient is established to be smaller than 1.0 in order to obtain a theoretical mixture ratio. When an acceleration operation of the internal combustion engine is carried out, a negative pressure of an intake pipe is reduced, and the intake air quantity is increased. As a result, the purge rate is reduced and the air-fuel ratio feedback correction coefficient becomes closer to 1.0. A technology for coping with such a change in the purge rate and keeping the air-fuel ratio at a target value is disclosed, for example, in the Japanese Patent Publication (unexamined) No.52139/1993.

The technology disclosed in the Japanese Patent Publication (unexamined) No.52139/1993 is provided with: a first injection quantity correcting means for correcting a fuel injection quantity using an air-fuel ratio feedback correction coefficient; a purge air concentration calculating means for calculating a purge air concentration per target purge rate on the basis of a deviation of the air-fuel ratio feedback correction coefficient caused at the time of carrying out the purge; and a second injection quantity correcting means for reducing the fuel injection quantity at the time of carrying out the purge on the basis of a product obtained by multiplying the purge air concentration by the purge rate. In this prior art, a maximum purge rate, that is a ratio of the purge quantity to the intake air quantity at the time of fully opening the purge control valve, is preliminarily stored in, and a duty ratio of the purge control valve is established to be a target purge rate/a maximum purge rate. Thus the target duty ratio is gradually increased when starting the purge.

In this prior art, the air-fuel ratio feedback correction coefficient is established to be not more than a predetermined value. When the air-fuel ratio is rich, a purge air concentration coefficient is increased by a certain value. Deviation of the air-fuel ratio feedback correction coefficient is caused to reflect on the purge air concentration coefficient at a fixed rate with intervals of fifteen seconds from the beginning of the purge. In this manner, the air-fuel ratio feedback correction coefficient is caused to come closer to 1.0. Accordingly, duty ratio of the purge control valve is controlled so that the purge rate may be constant regardless of the operating conditions of the internal combustion engine, and the fuel injection quantity is corrected on the basis of the product obtained by multiplying the purge rate by the purge air concentration even when the purge rate is changed, whereby the deviation of the air-fuel ratio in a transient period is prevented.

The Japanese Patent Publication (unexamined) No.121264/1996 discloses another technology. In this prior art, an initial value of the purge air concentration coefficient in the intake air is calculated on the basis of a deviation in the air-fuel ratio feedback correction coefficient caused at the time of starting the purge, the purge air concentration coefficient is gradually reduced from the initial value every time when a purge air is purged by a set quantity, and a fuel injection quantity is reduced on the basis of the purge air concentration coefficient at the time of carrying out the purge. In such an arrangement, if the air-fuel ratio feedback correction coefficient deviates from a predetermined range while reducing the purge air concentration coefficient, the reduction in the purge air concentration coefficient is temporarily stopped, thereby controlling the purge air concentration coefficient so as not to deviate from the actual purge air concentration.

The Japanese Patent Publication (unexamined) No. 261038/1996 discloses a further technology. In this prior art, a purge rate is calculated on the basis of a purge quantity and the operating conditions. Air-fuel ratio control means controls an air-fuel ratio feedback correction coefficient for correcting an air-fuel ratio of an air-fuel mixture fed into an internal combustion engine on the basis of a value detected by an air-fuel ratio sensor. Then, a purge air concentration is calculated on the basis of the purge rate and the air-fuel ratio feedback correction coefficient. A purge air concentration correction coefficient is calculated on the basis of the purge rate and the purge air concentration. A fuel injection quantity is calculated on the basis of the air-fuel ratio feedback correction coefficient and the purge air concentration correction coefficient. In this manner, the air-fuel ratio is controlled to be a target air-fuel ratio.

As described above, various techniques have been heretofore proposed about how to control the air-fuel ratio feedback correction coefficient at the time of carrying out purging operation. This air-fuel ratio feedback correction coefficient is an essential coefficient to be used in correcting an air-fuel ratio at the time of carrying out purging operation under the changing operating conditions to a theoretical air-fuel ratio, which is the target value.

However, if any deviation in air-fuel ratio feedback correction coefficient takes places, the deviation is corrected taking a relatively long time. In particular, when introducing a large amount of purge air under the condition of not carrying out any purging operation, a problem exists in that, during the period in which a deviation in air-fuel ratio feedback correction coefficient has been completely corrected, an air-fuel ratio cannot maintain its target value, and a rich condition continues for a predetermined time.

SUMMARY OF THE INVENTION

The present invention was made to resolve the above-discussed problems and has an object of obtaining an air-fuel ratio control apparatus for an internal combustion engine being capable of accurately controlling an air-fuel ratio to be a target value at all times when a purge air is introduced. The invention also provides a controlling method.

An air-fuel ratio control apparatus for an internal combustion engine according to the invention comprises: an operating condition detecting means for detecting operating conditions of the internal combustion engine; purge control quantity setting means for introducing a fuel vapor as a purge air into an intake system on the basis of a value detected by the operating condition detecting means and for controlling a quantity of the introduced purge air; an air-fuel ratio sensor for detecting an air-fuel ratio of an air-fuel mixture fed into the internal combustion engine; a fuel injection quantity calculating means for calculating a fuel injection quantity on the basis of an air-fuel ratio feedback correction coefficient that corresponds to a value detected by the air-fuel ratio sensor in order that the air-fuel ratio may be a target value; a purging state detecting means for detecting conditions of the purge air introduced by the purge control quantity setting means; and a purge air introduction correcting means for calculating a correction coefficient to correct the fuel injection quantity on the basis of a signal of the operating condition detecting means and a signal of the purging state detecting means, so that the air-fuel ratio that is changed by starting the introduction of the purge air may be kept at the target value.

As a result, the air-fuel ratio does not deviate from the target value even at the time immediately after starting the introduction of the purge air, and the air-fuel ratio is controlled with accuracy at all times.

It is preferable that the correction coefficient calculated by the purge air introduction correcting means is set according to a length of an introduction stopping period that ends at the time of starting the introduction of the purge air.

As a result, it is possible to correct the air-fuel ratio according to the concentration even when the introduction-stopping period is long and the concentration of the purge air is increased. Consequently, the air-fuel ratio is controlled with accuracy.

It is also preferable that the correction coefficient calculated by the purge air introduction correcting means is set according to the fed quantity of the purge air.

As a result, it is possible to control the air-fuel ratio according to the quantity of the introduced purge air, and the air-fuel ratio is controlled with accuracy.

It is also preferable that the air-fuel ratio control apparatus for an internal combustion engine comprises air-fuel ratio feedback correcting means for calculating the air-fuel ratio feedback correction coefficient, and the correction coefficient given from the purge air introduction correcting means to the fuel injection quantity calculating means is kept for a time equivalent to a delay in correction performed by the air-fuel ratio feedback correcting means.

As a result, it is possible to completely correct the deviation of the air-fuel ratio from the target value caused by the delay in the correction using the air-fuel ratio feedback correction coefficient.

A method for controlling an air-fuel ratio of an internal combustion engine according to the invention comprises the steps of: controlling a fuel injection quantity on the basis of an air-fuel ratio feedback correction coefficient that corresponds to an air-fuel ratio of an air-fuel mixture fed into the internal combustion engine; introducing a fuel vapor as a purge air into an intake system of the internal combustion engine according to operating conditions of the internal combustion engine; and controlling the fuel injection quantity according to a quantity of the introduced purge air in order to control the air-fuel ratio of the air-fuel mixture fed into the internal combustion engine to be a target value; wherein upon starting the introduction of the purge, the fuel injection quantity is reduced by a predetermined quantity during a predetermined period from the starting of the introduction of the purge air in order that the air-fuel ratio of the air-fuel mixture at the time immediately after the introduction of the purge air may be kept at the target value.

As a result, it is possible to obtain a method for controlling an air-fuel ratio of an internal combustion engine in which the air-fuel ratio does not become rich even at the time immediately after starting the operation of the purge control valve and it is possible to correct the deviation of the air-fuel ratio from the target value caused by the delay in the control using the air-fuel ratio feedback correcting means or the like.

It is preferable that a value of the predetermined quantity by which the fuel injection quantity is reduced is set according to a length of an introduction stopping period that ends at the time of starting the introduction of the purge air.

As a result, even if the stopping period of the purging operation is long and the concentration of the purge air is increased, the air-fuel ratio is controlled with accuracy.

It is also preferable that the value of the predetermined quantity by which the fuel injection quantity is reduced is set according to the quantity of the fed purge air.

As a result, it is possible to control the air-fuel ratio according to the quantity of the purge air and control the air-fuel ratio with accuracy.

It is preferable that the predetermined time for which the fuel injection quantity is reduced by the predetermined quantity is established to be equivalent to a delay in control using the air-fuel ratio feedback correction coefficient.

As a result, it is possible to completely correct the deviation of the air-fuel ratio from the target value caused by the delay in the correction using the air-fuel ratio feedback correction coefficient.

DESCRIPTION OF THE PREFERRED EMBODIMENTS

Embodiment 1.

Figure 1:
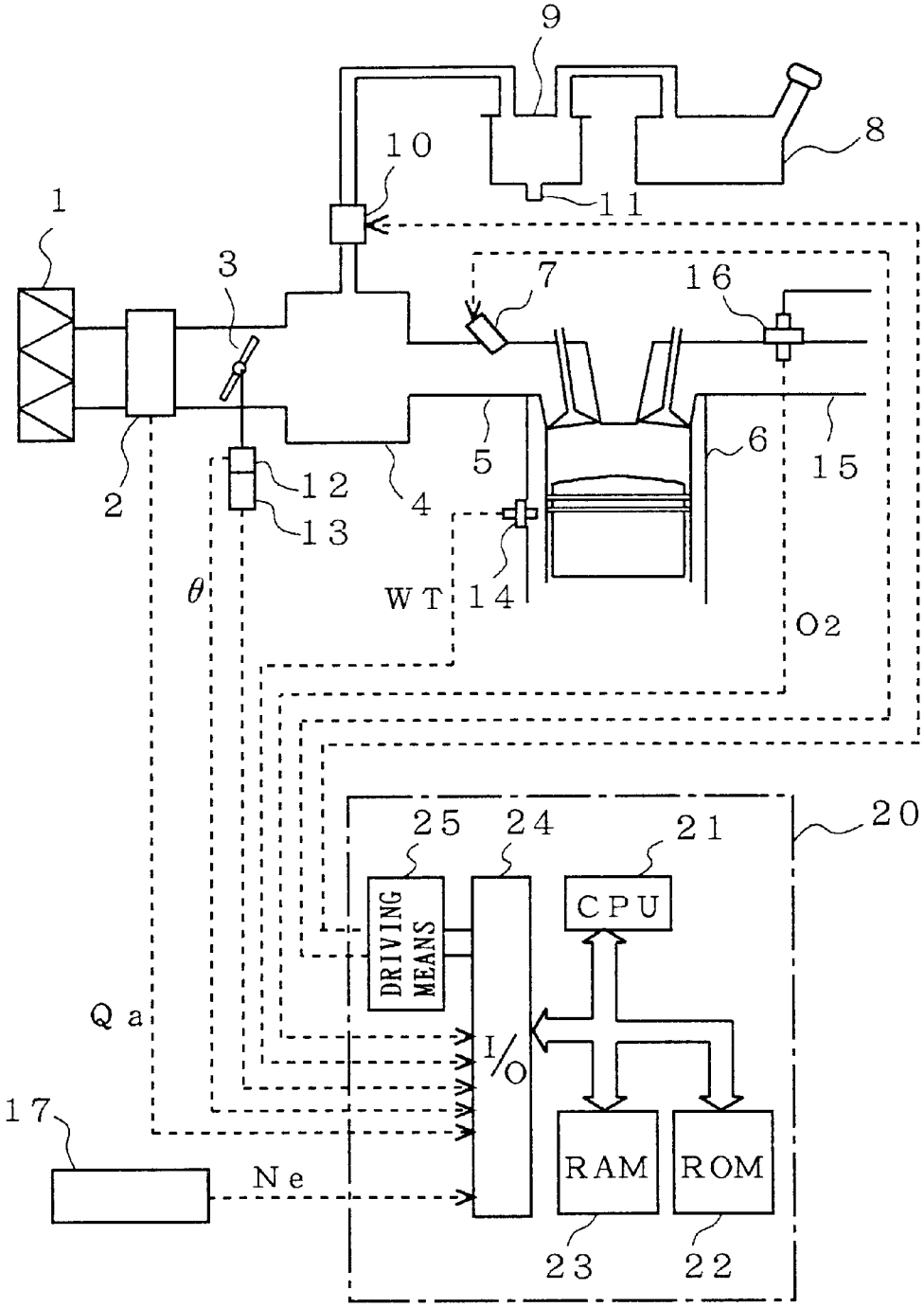
FIG. 1 is a schematic diagram of an air-fuel ratio control apparatus for an internal combustion engine according to Embodiment 1 of the present invention.
Figure 2:
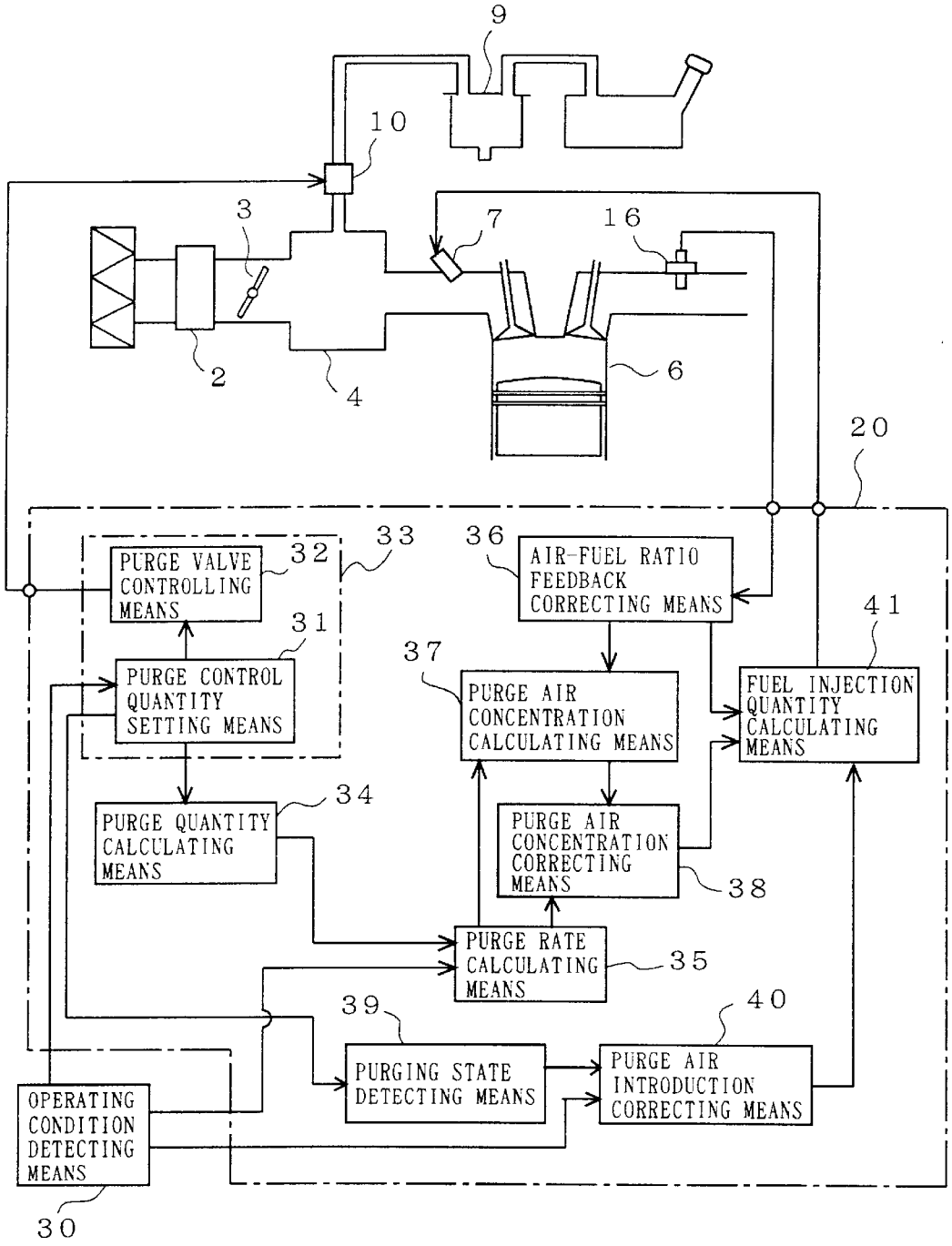
FIG. 2 is a functional block diagram of the air-fuel ratio control apparatus for an internal combustion engine according to Embodiment 1 of the invention.
Figure 3:
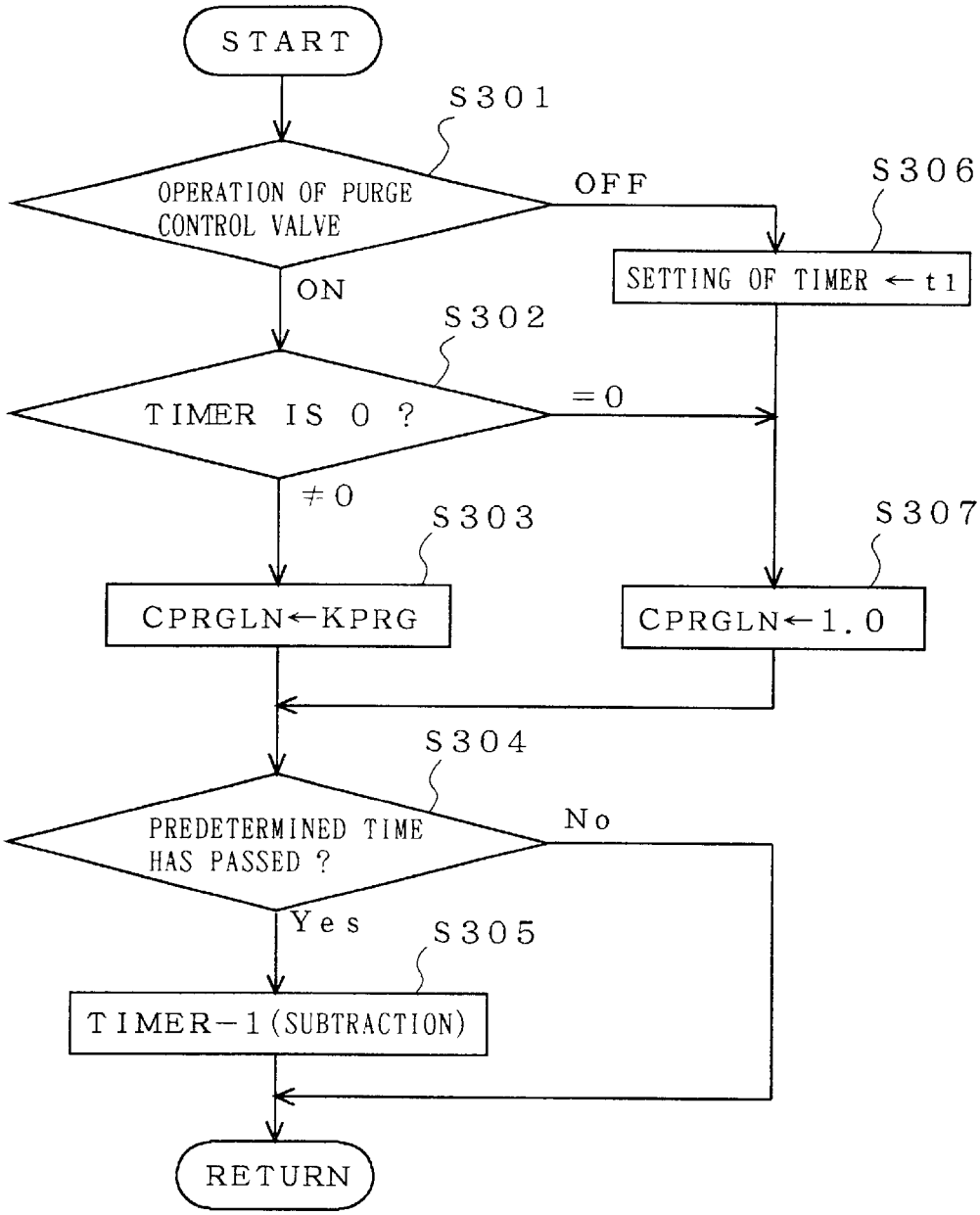
FIG. 3 is a flowchart for explaining how to set a correction coefficient of the air-fuel ratio control apparatus for an internal combustion engine according to Embodiment 1 of the invention.
Figure 4:
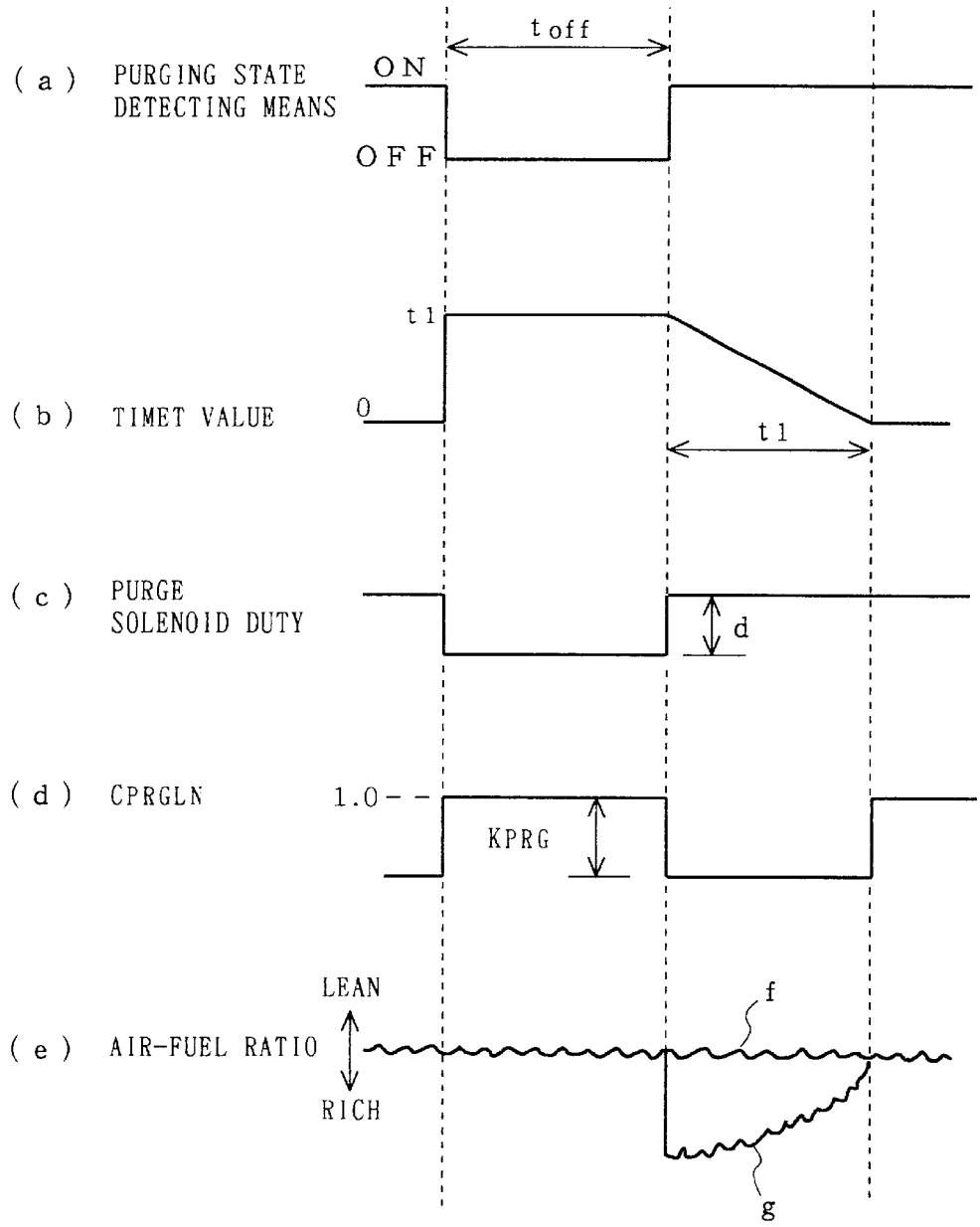
FIG. 4 is a diagram for explaining operation of the air-fuel ratio control apparatus for an internal combustion engine according to Embodiment 1 of the invention.

FIGS. 1 through 4 are to explain an air-fuel ratio control apparatus for an internal combustion engine according to Embodiment 1 of the invention. FIG. 1 is a diagram for explaining the entire arrangement, FIG. 2 is a functional block diagram for explaining the function, FIG. 3 is a flowchart for explaining the setting of a correction coefficient, and FIG. 4 is a graph for explaining the operation.

Referring to FIG. 1 showing the entire arrangement, an intake air quantity Qa taken in from an air cleaner 1 is measured by an airflow sensor 2. Throttle valve 3 controls the intake air quantity according to a load, and the intake air is sucked into each pipe of an internal combustion engine 6 through a surge tank 4 and an intake pipe 5. An injector 7 injects a fuel to the intake pipe 5. A canister 9 incorporated some activated charcoal therein adsorbs a fuel vapor generated in a fuel tank 8. When a purge control valve 10 is opened according to the operating conditions of the internal combustion engine 6, the fuel vapor in the canister 9 is purged due to a negative pressure in the surge tank 4. The purge takes place at the time when the air introduced from a canister air port 11 passes through the activated charcoal in the canister 9, whereby the air containing the fuel vapor, i.e., the purge air, is introduced into the surge tank 4.

The throttle valve 3 is provided with a throttle sensor 12 for measuring a throttle opening and an idle switch 13 to be turned on when the throttle opening is in an idling state. The internal combustion engine 6 is provided with a water temperature sensor 14 for measuring a temperature of cooling water. An exhaust pipe 15 of the internal combustion engine 6 is provided with an air-fuel ratio sensor 16, and the internal combustion engine 6 is provided with a crank angle sensor 17 for measuring an angle of rotation and a speed of rotation of a crankshaft. The intake air quantity Qa of the air flow sensor 2, the throttle opening θ measured by the throttle sensor 12, an ON signal of the idle switch 13, a cooling water temperature WT measured by the water temperature sensor 14, an air-fuel ratio signal O2 of the air-fuel ratio sensor 16, a engine speed Ne of the internal combustion engine 6 measured by the crank angle sensor 17, and so on are inputted into a control apparatus 20.

The control apparatus 20 is composed of a microcomputer comprised of a CPU 21, a ROM 22, and a RAM 23, an input/output interface 24, driving means 25 for driving the injector 7 and the purge control valve 10, and so on. Signals from the foregoing sensors are inputted through the input/output interface 24, and various types of control such as air-fuel ratio control and ignition timing control are carried out through the input/output interface 24. The foregoing sensors, i.e., the air flow sensor 2, the throttle sensor 12, the idle switch 13, the water temperature sensor 14, the air-fuel ratio sensor 16, the crank angle sensor 17, and so on are hereinafter collectively referred to as operating condition detecting means. The CPU 21 performs computation for air-fuel ratio feedback control on the basis of a control program and various maps stored in the ROM 22, and drives the injector 7 through the drive circuit 25.

The control apparatus 20 carries out various types of control such as control of ignition timing, control of an EGR, or control of an idle rotation speed. The control apparatus 20 further carries out so-called purging operation. In this purging operation, under the condition that warming up of the internal combustion engine 6 has completed, the cooling water temperature WT has increased to be not lower than a predetermined value and the engine speed Ne has increased to be not smaller than a predetermined value, a purge signal is outputted according to the operating conditions in order to open the purge control valve 10 and purge the fuel vapor adsorbed by the activated charcoal of the canister 9 into the surge tank 4 as the purge air. When the internal combustion engine 6 comes into an idling condition, this idling is detected by the signal of the idle switch 13, and the purge control valve 10 is closed to cut the purge air from the canister 9. The purge control valve 10 is closed to cut the purge air from the canister 9 also when the intake air quantity Qa and the engine speed Ne of the internal combustion engine 6 are over the predetermined values.

In order to carry out such a control, the control apparatus 20 performs a function as shown in FIG. 2. Referring to the functional block diagram shown in FIG. 1, as described above, the sensors for detecting the operating conditions of the internal combustion engine 6 such as the air flow sensor 2 and the throttle sensor 12 are collectively referred to as operating condition detecting means 30. Purge control quantity setting means 31 sets a purge control quantity according to an input of the operating conditions of the internal combustion engine 6 detected by this operating condition detecting means 30. Purge valve controlling means 32 controls an opening proportion (duty) of the purge control valve 10 according to the output of the set purge control quantity. The purge control quantity setting means 31 and the purge valve controlling means 32 form purge controlling means 33.

The purge control quantity set by the purge controlling means 33 is inputted to a purge quantity calculating means 34, and the purge quantity calculating means 34 calculates the purge quantity introduced into the intake pipe 5 on the basis of the purge control quantity. The operating conditions of the internal combustion engine 6 detected by the operating condition detecting means 30 and the purge quantity calculated by the purge quantity calculating means 34 are inputted to a purge rate calculating means 35. This purge rate calculating means 35 calculates a purge rate, i.e., a ratio of the intake air quantity to the purge quantity. Air-fuel ratio feedback correcting means 36 controls the air-fuel ratio by inputting an air-fuel ratio signal from the air-fuel ratio sensor 16, and calculating an air-fuel ratio feedback correction coefficient for correcting the fuel injection quantity so that the air-fuel ratio may be a target air-fuel ratio. The calculated air-fuel ratio feedback correction coefficient is applied to fuel injection quantity calculating means 41 thereby the air-fuel ratio being controlled.

The output of the air-fuel ratio feedback correcting means 36 is also given to purge air concentration calculating means 37. The purge air concentration calculating means 37 calculates a purge air concentration on the basis of the purge rate and the deviation of the air-fuel ratio feedback correction coefficient caused at the time of carrying out the purge. Purge air concentration correcting means 38 calculates a purge air concentration correction coefficient for correcting the fuel injection quantity on the basis of the purge air concentration and the purge rate. The purge air concentration correcting means 38 then gives the purge air concentration correction coefficient to the fuel injection quantity calculating means 41 and corrects the deviation of the air-fuel ratio feedback correction coefficient in order to keep the air-fuel ratio at a target value. By carrying out these operations, the air-fuel ratio under steady state is controlled to be a target value such as a theoretical air-fuel ratio.

Purging state detecting means 39 detects a control condition of the purge valve 10 according to the output of the purge control quantity setting means 31. Purge air introduction correcting means 40 inputs the output of the operating condition detecting means 30 and the output of the purging state detecting means 39. The purge air introduction correcting means 40 calculates and sets a purge air introduction correction coefficient for correcting the air-fuel ratio that is changed by starting the introduction of the purge air and outputs the purge air introduction correction coefficient to the fuel injection quantity calculating means 41. This purge air introduction correction coefficient is used to correct the air-fuel ratio under the transient period at the time of starting introduction of the purge air. The fuel injection quantity calculating means 41 calculates a fuel injection quantity on the basis of the air-fuel ratio feedback correction coefficient, the purge air concentration correction coefficient, and the purge air introduction correction coefficient, and outputs the fuel injection quantity to the injector 7.

In the control apparatus 20 of above arrangement, the fuel injection quantity calculating means 41 calculates a fuel injection quantity Qf by the following expression.

$$Qf=\{(Qa/Ne)/\text{target air-fuel ratio}\}\times CFB\times CPRG\times CPRGLN\times K+\alpha \quad (1)$$

where: Qa indicates an intake air quantity, Ne indicates an engine speed of an internal combustion engine, CFB indicates an air-fuel ratio feedback correction coefficient, CPRG indicates a purge air concentration correction coefficient, CPRGLN indicates a purge air introduction correction coefficient, K indicates a correction coefficient I, and $\alpha$ indicates a correction coefficient II.

The correction coefficient I of K is a correction coefficient such as a warming up correction, and the correction coefficient II of $\alpha$ is a correction coefficient such as an acceleration increment. In the case that any correction is not necessary, K=1.0 and $\alpha$=0. The purge air concentration correction coefficient of CPRG is used to correct the fuel injection quantity on the basis of the purge air concentration and the purge rate when the purging operation is carried out. CPRG=1.0 when any purging operation is not carried out.

In the purging operation, the purge quantity calculating means 34 calculates a quantity of the introduced purge air, i.e., a purge quantity, according to the output of the purge control quantity setting means 31. The purge rate calculating means 35 calculates a purge rate from this purge quantity and the intake air quantity Qa that is one of outputs of the operating condition detecting means 30. The output of the air-fuel ratio sensor 16 is inputted to the air-fuel ratio feedback correcting means 36, and the air-fuel ratio feedback correcting means 36 calculates an air-fuel ratio feedback correction coefficient CFB. The air-fuel ratio feedback correcting means 36 further calculates an integrated value of an air-fuel ratio feedback correction quantity equivalent to an average air-fuel ratio feedback correction quantity.

The purge air concentration calculating means 37 calculates a purge air concentration on the basis of the purge rate and the integrated value of the air-fuel ratio feedback correction quantity. The purge air concentration correcting means 38 calculates a purge air concentration correction coefficient CPRG for correcting the air-fuel ratio, which changes according to the fuel contained in the purge air, to be a target air-fuel ratio on the basis of the purge rate and the purge air concentration. The purge air concentration correction coefficient CPRG calculated in this manner is then inputted to the fuel injection quantity calculating means 41 to correct a variation in the air-fuel ratio caused by the purge air.

The air-fuel ratio feedback correction coefficient CFB is used to control the air-fuel ratio to be the target air-fuel ratio on the basis of the output signal of the air-fuel ratio sensor 16. The air-fuel ratio feedback correction coefficient CFB is set to near 1.0 being the reference value when any purging operation is not carried out, and is set to a value smaller than 1.0 when any purging operation is carried out. This air-fuel ratio feedback correction coefficient CFB and the foregoing purge air concentration correction coefficient CPRG are calculated through a publicly known art as is described, for example, in the Japanese Patent Publication (unexamined) No. 261038/1996. Therefore no detailed description of the manner of calculation is given herein because it does not directly relate to the invention.

Described below is a purge air introduction correction coefficient CPRGLN, i.e., the correction coefficient for correcting an air-fuel ratio changed by starting the introduction of a purge air. This purge air introduction correction coefficient CPRGLN is one of the characteristics of the invention and is used together with the air-fuel ratio feedback correction coefficient CFB and the purge air concentration correction coefficient CPRG in the calculation of the foregoing Expression (1). The purge air introduction correction coefficient CPRGLN is used in correction for controlling the change in air-fuel ratio caused by introduction of the purge air when changed from a state of not introducing any purge air to a state of introducing any purge air. CPRGLN=1.0 when it is not necessary to correct the fuel by introduction of the purge air.

As mentioned above, in the prior art, when an air-fuel ratio is deviated from a target air-fuel ratio by the introduction of the purge air, it takes a time in correcting this deviation to the target air-fuel ratio using the air-fuel ratio feedback correction coefficient CFB. This is because it takes a time in updating the air-fuel ratio feedback correction coefficient CFB. On the other hand, in the present invention, when changed from a state of not introducing any purge air to a state of introducing any purge air, the purge air introduction correction coefficient CPRGLN is set, and a feed forward control is carried out according to the introduction of the purge air. Accordingly, the air-fuel ratio is controlled to be a target air-fuel ratio. As a result, the air-fuel ratio is swiftly controlled to be the target air-fuel ratio, and the air-fuel ratio does not deviate from the target air-fuel ratio.

The purge air introduction correction coefficient CPRGLN is calculated by the purge air introduction correcting means 40 according to the output of the operating condition detecting means 30 and that of the purging state detecting means 39. An example of calculating process of the purge air introduction correction coefficient CPRGLN is hereinafter described with reference to FIG. 3. This processing is carried out in the control apparatus 20 every predetermined time. First, in step S301, the purging state detecting means 39 detects whether or not any purge air is introduced. In this step S301, if the purge control valve 10 is off and any purge air is not introduced, the process proceeds to step S306, and a predetermined value t1 is set on a timer whose value is subtracted in step S305 described later.

The value of this timer is subtracted in step S305, however, if the value of the timer is 0, it is not subtracted but kept at 0. Then, the process proceeds to step S307, where the purge air introduction correction coefficient CPRGLN is set to 1.0, and the process proceeds to step S304. On the other hand, in step S301, if the purge control valve 10 is on and any purge air is introduced, the process proceeds to step S302, and the value of the timer is judged. If the value of the timer is 0, the process proceeds to step S307, and if the value of the timer is not 0, the process proceeds to step S303.

In step S303, a coefficient KPRG is set for the purge air introduction correction coefficient CPRGLN, and the process proceeds to step S304, where a predetermined time besides the forgoing routine repeat time has passed or not is judged. If the predetermined time has not passed, the process proceeds to return. If the predetermined time has passed, the process proceeds to step S305, where the value of the timer is subtracted, and the process proceeds to return. The coefficient KPRG is a coefficient for reducing the fuel injection quantity and is a value smaller than 1.0.

Described below is explanation of this operation with reference to the time chart in FIG. 4. In the drawing, (a) indicates a detection signal of the purging state detecting means 39, and this signal is synchronized with a signal which is outputted by the purge valve controlling means 32 and used to operate the purge control valve 10. (b)in the drawing indicates an operating conditions of the timer, (c) indicates a state of change of the duty of the purge solenoid operating the purge control valve 10, (d) indicates a state of change of the purge air introduction correction coefficient CPRGLN, and (e) indicates a state of change of the air-fuel ratio. If a value is set for the duty of the purge solenoid, the purge air is introduced, and the purge control valve 10 is on. If the duty of the purge solenoid is 0, the purge air is not introduced and the purge control valve 10 is off.

When the output of the purge valve controlling means 32 changes from on to off, t1 is set for the timer synchronizing with the change from on to off (step S306), the purge air introduction correction coefficient CPRGLN is set at 1.0 (step S307), and the duty of the purge solenoid becomes off, i.e., 0. When a stop time toff of the purge has passed and the detection of the purging state detecting means 39 is on again, subtraction of the value of the timer per routine starts, duty d is given to the purge solenoid operating the purge control valve 10, and the coefficient KPRG is set for the purge air introduction correction coefficient CPRGLN (step S303). The value of the timer is subtracted per routine and becomes 0 after the predetermined time t1, and the correction is finished and the purge air introduction correction coefficient CPRGLN returns to 1.0 (step S307).

As shown in (e) in the drawing, the air-fuel ratio is accurately controlled to be the target air-fuel ratio using the air-fuel ratio feedback correction coefficient CFB and the purge air concentration correction coefficient CPRG except for a case where the situation is changed from the state in which the purge air is not introduced to the state in which the purge air is introduced (in other words, a case where the output of the purge valve controlling means 32 is changed from off to on). However, when the correction is carried out using only the air-fuel ratio feedback correction coefficient CFB and the purge air concentration correction coefficient CPRG, there is a delay of correction using the air-fuel ratio feedback correction coefficient CFB and the purge air concentration correction coefficient CPRG in a period of the predetermined time t1 that begins at the moment when the purge air is introduced. As indicated with (g) of an air-fuel ratio characteristic in FIG. 4, the air-fuel ratio is moved to the rich side, gradually controlled toward the target value during the time t1, and changed.

In the air-fuel ratio control apparatus for an internal combustion engine according to Embodiment 1 of the invention, as shown in the foregoing Expression (1), the purge air introduction correction coefficient CPRGLN is used in the calculation of the fuel injection quantity Qf by the fuel injection quantity calculating means 41, and the quantity of the fuel to be fed is corrected. As a result, as indicated with (f) of the air-fuel ratio characteristic in FIG. 4, the air-fuel ratio is controlled without deviating from the target value. Therefore, the value of KPRG set as the purge air introduction correction coefficient CPRGLN in the foregoing step S303 is determined according to the quantity of the fuel vapor contained in the introduced purge air, and the time t1 set in step S306 is equivalent to the delay time of correction using the air-fuel ratio feedback correction coefficient CFB and the purge air concentration correction coefficient CPRG.

Embodiment 2.

Figure 5:
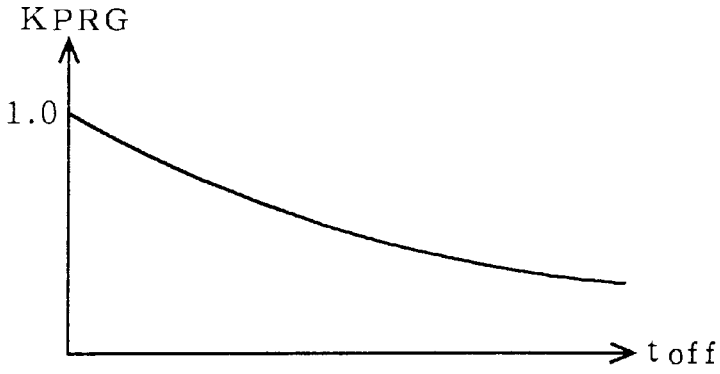
FIG. 5 is a graph for explaining a purge air introduction correction coefficient of an air-fuel ratio control apparatus for an internal combustion engine according to Embodiment 2 of the invention.

FIG. 5 is used to explain how the purge air introduction correction coefficient CPRGLN is set by the purge air introduction correcting means in Embodiment 2 of this invention. As described in the foregoing Embodiment 1, the purge air introduction correction coefficient CPRGLN is used in the calculation of the fuel injection quantity Qf by the fuel injection quantity calculating means 41, and the coefficient KPRG is introduced for the value of this CPRGLN in step S303 in FIG. 3. In this embodiment, the introduced coefficient KPRG is set as shown in FIG. 5. The axis of abscissas in FIG. 5 is toff, which is the length of the purge air stop time shown in FIG. 4. The quantity of the fuel vapor stored in the canister 9 increases and the concentration of the purge air increases as the purge air stop time is longer. Therefore KPRG is set at a small value, and setting KPRG in this manner makes it possible to control so that the air-fuel ratio may change less when the introduction of the purge air starts.

Embodiment 3.

Figure 6:
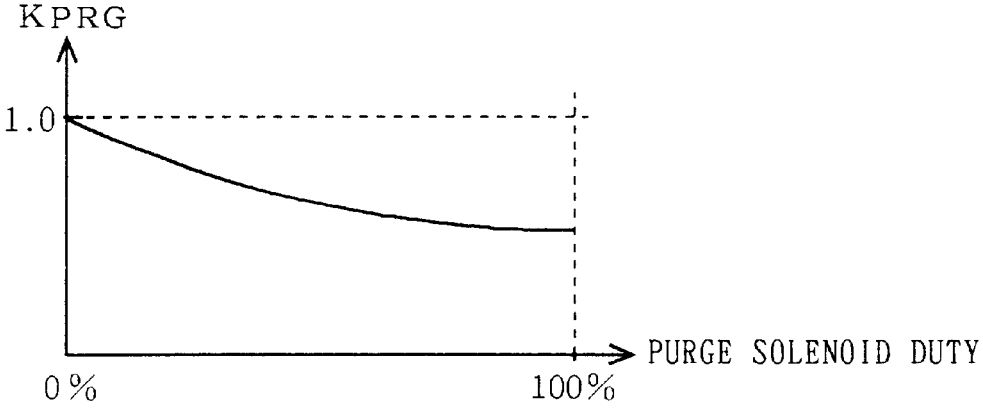
FIG. 6 is a graph for explaining a purge air introduction correction coefficient of an air-fuel ratio control apparatus for an internal combustion engine according to Embodiment 3 of the invention.

FIG. 6 is used to explain how the purge air introduction correction coefficient CPRGLN is set by the purge air introduction correcting means in Embodiment 3 of this invention. This embodiment relates to setting of the coefficient KPRG as well as Embodiment 2. In this embodiment, as shown in FIG. 6, the value of the coefficient KPRG is set according to the duty of the purge solenoid. The quantity of the purge air increases as the duty of the purge solenoid increases, and the value of the coefficient KPRG is accordingly set at a small value. Setting KPRG in this manner makes it possible to control so that the air-fuel ratio may change less when the introduction of the purge air starts.

It is to be understood that the invention is not limited to the foregoing embodiments and various changes and modifications may be made without departing from the spirit and scope of the invention.

What is claimed is:

1. An air-fuel ratio control apparatus for an internal combustion engine, comprising:

an operating condition detecting means for detecting operating conditions of the internal combustion engine;

a purge control quantity setting means for introducing fuel vapor as purge air into an intake system on the basis of a value detected by said operating condition detecting means and controlling a quantity of the introduced purge air;

an air-fuel ratio sensor detecting an air-fuel ratio of air-fuel mixture fed into said internal combustion engine;

a fuel injection quantity calculating means for calculating a fuel injection quantity on the basis of an air-fuel ratio feedback correction coefficient that corresponds to a value detected by said air-fuel ratio sensor in order that said air-fuel ratio may be a target value;

a purging state detecting means for detecting a state of the purge air introduced by said purge control quantity setting means; and a purge air introduction correcting means for calculating a correction coefficient for correcting said fuel injection quantity based on a signal of said operating condition detecting means and a signal of said purging state detecting means, so that the air-fuel ratio, which is changed due to a start of the introduction of the purge air, may be kept at said target value.

2. The air-fuel ratio control apparatus for an internal combustion engine according to claim 1, wherein said correction coefficient calculated by said purge air introduction correcting means is set according to a length of an introduction stopping period that ends when the introduction of the purge air starts.

3. The air-fuel ratio control apparatus for an internal combustion engine according to claim 1, wherein said correction coefficient calculated by said purge air introduction correcting means is set according to the quantity of the fed purge air.

4. The air-fuel ratio control apparatus for an internal combustion engine according to claim 1, further comprising an air-fuel ratio feedback correcting means for calculating said air-fuel ratio feedback correction coefficient, wherein said correction coefficient given from said purge air introduction correcting means to said fuel injection quantity calculating means is kept for a time equivalent to a delay time of correction by said air-fuel ratio feedback correcting means.

5. A method for controlling an air-fuel ratio of an internal combustion engine, comprising the steps of:

controlling a fuel injection quantity on the basis of an air-fuel ratio feedback correction coefficient that corresponds to an air-fuel ratio of air-fuel mixture fed into the internal combustion engine;

introducing fuel vapor as purge air into an intake system of said internal combustion engine according to operating condition of said internal combustion engine;

controlling the fuel injection quantity according to a quantity of the introduced purge air in order to control the air-fuel ratio of the air-fuel mixture fed into said internal combustion engine to be a target value; and reducing said fuel injection quantity by a predetermined quantity during a predetermined time period after a start of the introduction of said purge air in order that the air-fuel ratio of said air-fuel mixture may be kept at the target value in a stage where the introduction of said purge air has just started.

6. The method for controlling an air-fuel ratio of an internal combustion engine according to claim 5, wherein the value of the predetermined quantity by which said fuel injection quantity is reduced is set according to a length of an introduction stopping period that ends when the introduction of the purge air starts.

7. The method for controlling an air fuel ratio of an internal combustion engine according to claim 5, wherein the value of the predetermined quantity by which said fuel injection quantity is reduced is set according to the quantity of the fed purge air.

8. The method for controlling an air-fuel ratio of an internal combustion engine according to claim 5, wherein the predetermined time for which said fuel injection quantity is reduced by the predetermined quantity is arranged to be equivalent to a delay time of control using said air-fuel ratio feedback correction coefficient.

* * * * *